US009334605B2

(12) United States Patent
Whitney

(10) Patent No.: US 9,334,605 B2
(45) Date of Patent: May 10, 2016

(54) STEAM IRON

(71) Applicant: Hamilton Beach Brands, Inc., Glen Allen, VA (US)

(72) Inventor: Linda Whitney, Fredericksburg, VA (US)

(73) Assignee: Hamilton Beach Brands, Inc., Glen Allen, VA (US)

( * ) Notice: Subject to any disclaimer, the term of this patent is extended or adjusted under 35 U.S.C. 154(b) by 0 days.

(21) Appl. No.: 14/617,019

(22) Filed: Feb. 9, 2015

(65) Prior Publication Data

US 2015/0225889 A1 Aug. 13, 2015

Related U.S. Application Data

(60) Provisional application No. 61/938,382, filed on Feb. 11, 2014.

(51) Int. Cl.

| | |
|---|---|
| ***D06F 75/14*** | (2006.01) |
| ***D06F 75/36*** | (2006.01) |
| ***B65D 47/32*** | (2006.01) |
| ***B65D 51/16*** | (2006.01) |

(52) U.S. Cl.

CPC ..... *D06F 75/14* (2013.01); *B65D 47/32* (2013.01); *B65D 51/16* (2013.01); *B65D 51/1611* (2013.01); *D06F 75/36* (2013.01)

(58) Field of Classification Search

CPC ..... D06F 75/00; D06F 75/06; D06F 75/10; D06F 75/14; D06F 75/18; D06F 75/22; D06F 75/36; B65D 47/32; B65D 51/16; B65D 51/1611

USPC ..... D32/68, 70

See application file for complete search history.

(56) References Cited

U.S. PATENT DOCUMENTS

| | | | | |
|---|---|---|---|---|
| 2,680,312 | A * | 6/1954 | Parr | D06F 75/14 38/77.83 |
| 2,861,365 | A * | 11/1958 | Block | A63H 33/30 219/245 |
| 4,233,763 | A * | 11/1980 | McMullen | D06F 75/38 38/77.83 |
| 5,408,769 | A | 4/1995 | Patrick | |
| 5,414,945 | A | 5/1995 | Freeman et al. | |
| 5,446,983 | A | 9/1995 | Patrick | |
| 6,243,976 | B1 | 6/2001 | Beverly et al. | |
| 6,389,717 | B2 | 5/2002 | Maier et al. | |
| 6,807,755 | B2 | 10/2004 | Bontems et al. | |
| 7,017,290 | B2 * | 3/2006 | Bontems | D06F 75/14 38/88 |
| D550,915 | S | 9/2007 | Poon | |
| 7,546,701 | B2 | 6/2009 | Alipour | |
| 7,552,552 | B1 | 6/2009 | Garman et al. | |
| D610,764 | S | 2/2010 | Massip et al. | |
| D610,765 | S | 2/2010 | Massip et al. | |
| D624,266 | S | 9/2010 | Massip et al. | |
| D656,285 | S | 3/2012 | Massip et al. | |
| 8,539,700 | B2 * | 9/2013 | Saba | D06F 75/00 38/141 |

* cited by examiner

*Primary Examiner* — Ismael Izaguirre
(74) *Attorney, Agent, or Firm* — Alexancer D. Raring

(57) ABSTRACT

A steam iron comprises a housing, a handle supported by or integral with the housing, a soleplate having a plurality of steam vents defined therein, a water reservoir supported by the housing for holding water to be converted to steam, and a water fill funnel supported by the housing and/or the handle for adding water to the reservoir. The water fill funnel has a top rim defining a top opening. The water fill funnel defines a bottom opening that is in fluid connection with the water reservoir. At least a portion of the water fill funnel is external to the housing.

19 Claims, 9 Drawing Sheets

STEAM IRON

CROSS-REFERENCE TO RELATED APPLICATIONS

This application claims priority to U.S. Provisional Application Ser. No. 61/938,382, filed Feb. 11, 2014, the contents of which are incorporated herein by reference in its entirety.

BACKGROUND OF THE DISCLOSURE

The present disclosure relates generally to clothes irons, and more specifically to steam irons.

Clothes irons (also termed clothing irons, flatirons, or simply irons) are well known appliances used for applying heat and pressure to smooth wrinkles in clothing and other fabrics. Clothes irons comprise a heating element that heats up a metallic soleplate, such that the hot soleplate may be pressed against fabric to smooth wrinkles.

Steam irons are a subset of clothes irons. Steam irons enable steam to be produced and applied to clothing in order to increase an iron's ability to smooth wrinkles and/or to enable wrinkles to be smoothed in fabric that may be more difficult to smooth, such as cotton. Steam irons further comprise a water tank and a valve to selectively release water from the water tank onto an interior surface of the hot soleplate. The hot soleplate vaporizes the water and the resulting steam is released through holes in the soleplate.

Steam irons comprise one or more openings for putting water into the water tank. Such tank fill openings are typically quite small such that only a small amount of water may pass through a tank fill opening at any given time. As such, water must be slowly poured into the tank fill opening to prevent water from backing up and overflowing the tank fill opening such that water would spill down the sides of the steam iron, thereby necessitating cleaning up of the spilled water. As water is poured into the water tank through the tank fill opening, the water displaces air in the tank and the displaced air must exit the water tank. Typically, the displaced air must exit the water tank through the tank fill opening, which further reduces the amount of water that may pass through a tank fill opening at any given time. If water is poured too quickly into the tank fill opening, the displaced air will bubble up through the water attempting to pass through the tank fill opening, thereby potentially causing water to spill down the sides of the steam iron.

It has heretofore not been discovered how to create a steam iron that may be quickly and easily be filled with water with a reduced risk of spilling water during the filling process. The steam iron of the following disclosure accomplishes the above and other objectives and overcomes at least the above-described disadvantages of conventional steam irons.

BRIEF SUMMARY OF THE DISCLOSURE

A steam iron used for applying heat and pressure to smooth wrinkles in clothing and other fabrics is disclosed herein. In one embodiment of the subject appliance, the steam iron comprises a housing, a handle supported by or integral with the housing, a soleplate having a plurality of steam vents defined therein, a water reservoir supported by the housing for holding water to be converted to steam, and a water fill funnel supported by the housing and/or the handle for adding water to the reservoir. The water fill funnel has a top rim defining a top opening. The water fill funnel defines a bottom opening that is in fluid connection with the water reservoir. At least a portion of the water fill funnel is external to the housing.

The water fill funnel may comprise an upper portion which includes the top rim and which extends outward from the housing and/or the handle.

The water fill funnel may comprise an outer wall which extends outward from the housing and/or the handle.

The water fill funnel may further comprise an inner wall that has at least two different slopes. The at least two different slopes may comprise an upper slope and a lower slope, the upper slope being steeper than the lower slope.

The water fill funnel may further comprise opposing planar restrictions flanking the bottom opening of the water fill funnel.

The steam iron may further comprise a vent tube having an upper end that is above the bottom opening of the water fill funnel and a lower end that is below the bottom opening of the water fill funnel.

A width of the top opening of the water fill funnel may be about 40% of a total width of the steam iron. A length of the top opening of the water fill funnel may be about 20% of a total length of the steam iron. A depth of the water fill funnel may be about 25% of a total height of the steam iron.

In one alternative embodiment of the disclosure, a steam iron comprises a housing, a handle supported by or integral with the housing, a soleplate having a plurality of steam vents defined therein, a water reservoir supported by the housing for holding water to be converted to steam, and a water fill funnel supported by the housing and/or the handle for adding water to the reservoir. The water fill funnel has a top rim defining a top opening. The water fill funnel defines a bottom opening that is in fluid connection with the water reservoir. The water fill funnel has an inner wall having at least two different slopes.

The at least two different slopes may comprise an upper slope and a lower slope, the upper slope being steeper than the lower slope.

The water fill funnel may further comprise opposing planar restrictions flanking the bottom opening of the water fill funnel.

The steam iron may further comprise a vent tube having an upper end that is above the bottom opening of the water fill funnel and a lower end that is below the bottom opening of the water fill funnel.

The water fill funnel may further comprise an upper portion which includes the top rim and which projects outward from the housing and/or the handle.

A width of the top opening of the water fill funnel may be about 40% of a total width of the steam iron. A length of the top opening of the water fill funnel may be about 20% of a total length of the steam iron. A depth of the water fill funnel may be about 25% of a total height of the steam iron.

At least a portion of the water fill funnel may be external to the housing.

The water fill funnel may comprise an upper portion which includes the top rim and which extends outward from the housing and/or the handle.

The water fill funnel may comprise an outer wall which extends outward from the housing and/or the handle.

In another alternative embodiment of the disclosure, a steam iron comprises a housing, a handle supported by or integral with the housing, a soleplate having a plurality of steam vents defined therein a water reservoir supported by the housing for holding water to be converted to steam, a water fill funnel supported by the housing and/or the handle for adding water to the reservoir, and a vent tube having an upper end that is above the bottom opening of the water fill funnel and a lower end that is below the bottom opening of the water fill funnel. The water fill funnel has a top rim defining a top opening. The water fill funnel defines a bottom opening that is in fluid connection with the water reservoir.

The water fill funnel may comprise an inner wall that has at least two different slopes. The at least two different slopes may comprise an upper slope and a lower slope, the upper slope being steeper than the lower slope.

The water fill funnel may further comprise opposing planar restrictions flanking the bottom opening of the water fill funnel.

The water fill funnel may further comprise an upper portion which includes the top rim and which projects outward from the housing and/or the handle.

A width of the top opening of the water fill funnel may be about 40% of a total width of the steam iron. A length of the top opening of the water fill funnel may be about 20% of a total length of the steam iron. A depth of the water fill funnel may be about 25% of a total height of the steam iron.

At least a portion of the water fill funnel may be external to the housing.

The water fill funnel may comprise an upper portion which includes the top rim and which extends outward from the housing and/or the handle.

The water fill funnel may comprise an outer wall which extends outward from the housing and/or the handle.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
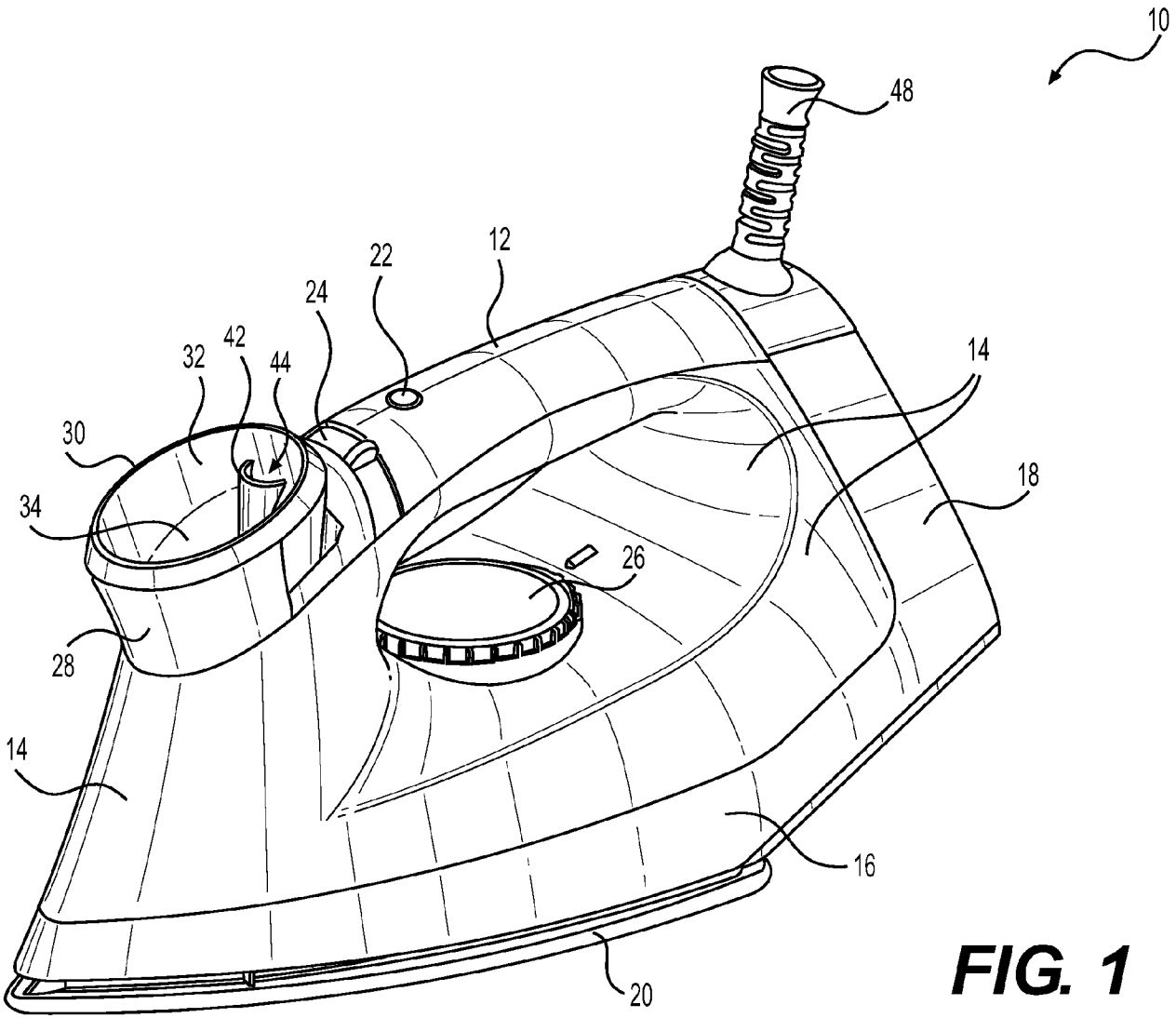
FIG. 1 is a perspective view of a steam iron, according to one embodiment of the present disclosure.
Figure 2:
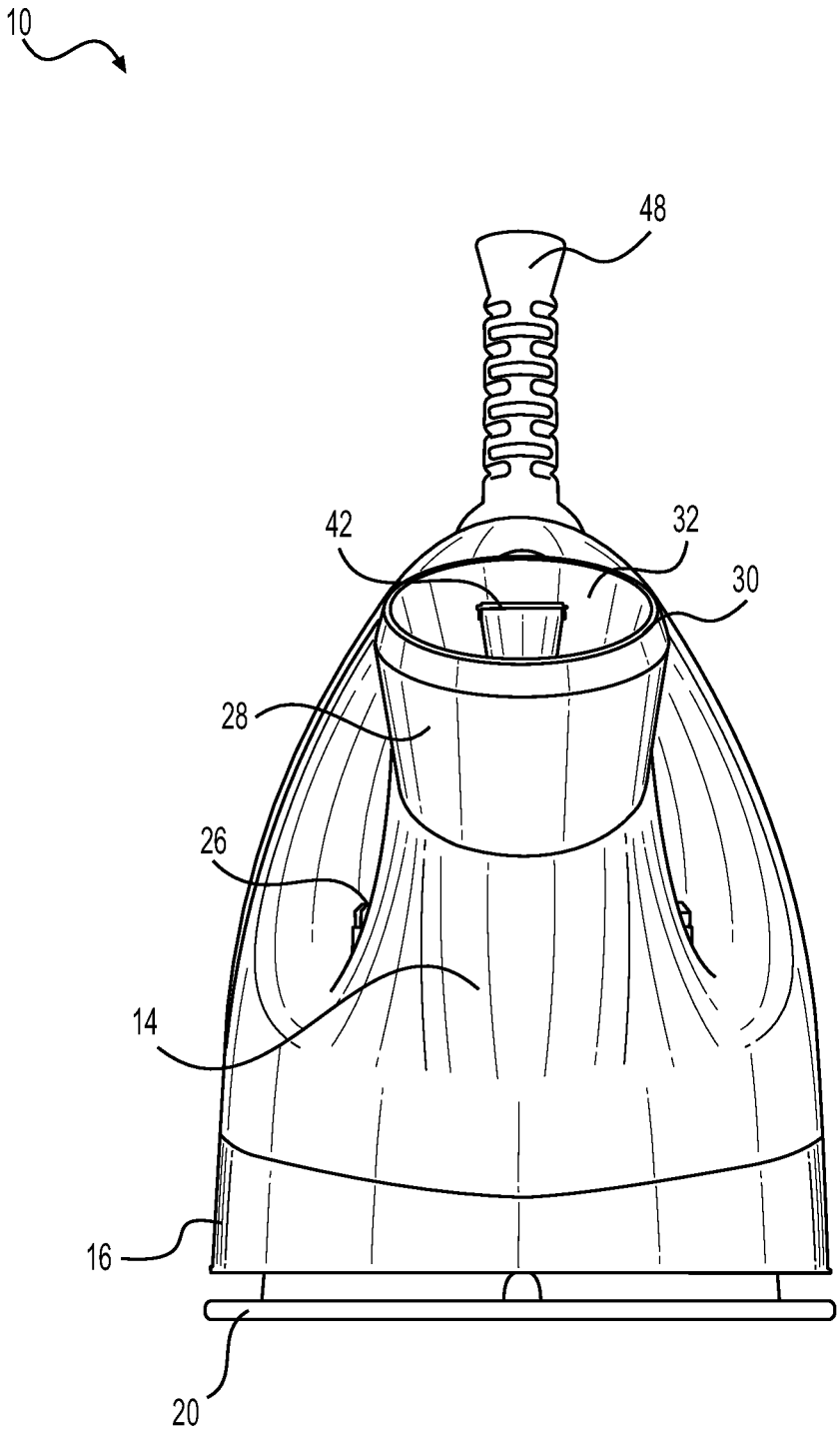
FIG. 2 is front view of the steam iron of FIG. 1.
Figure 3:
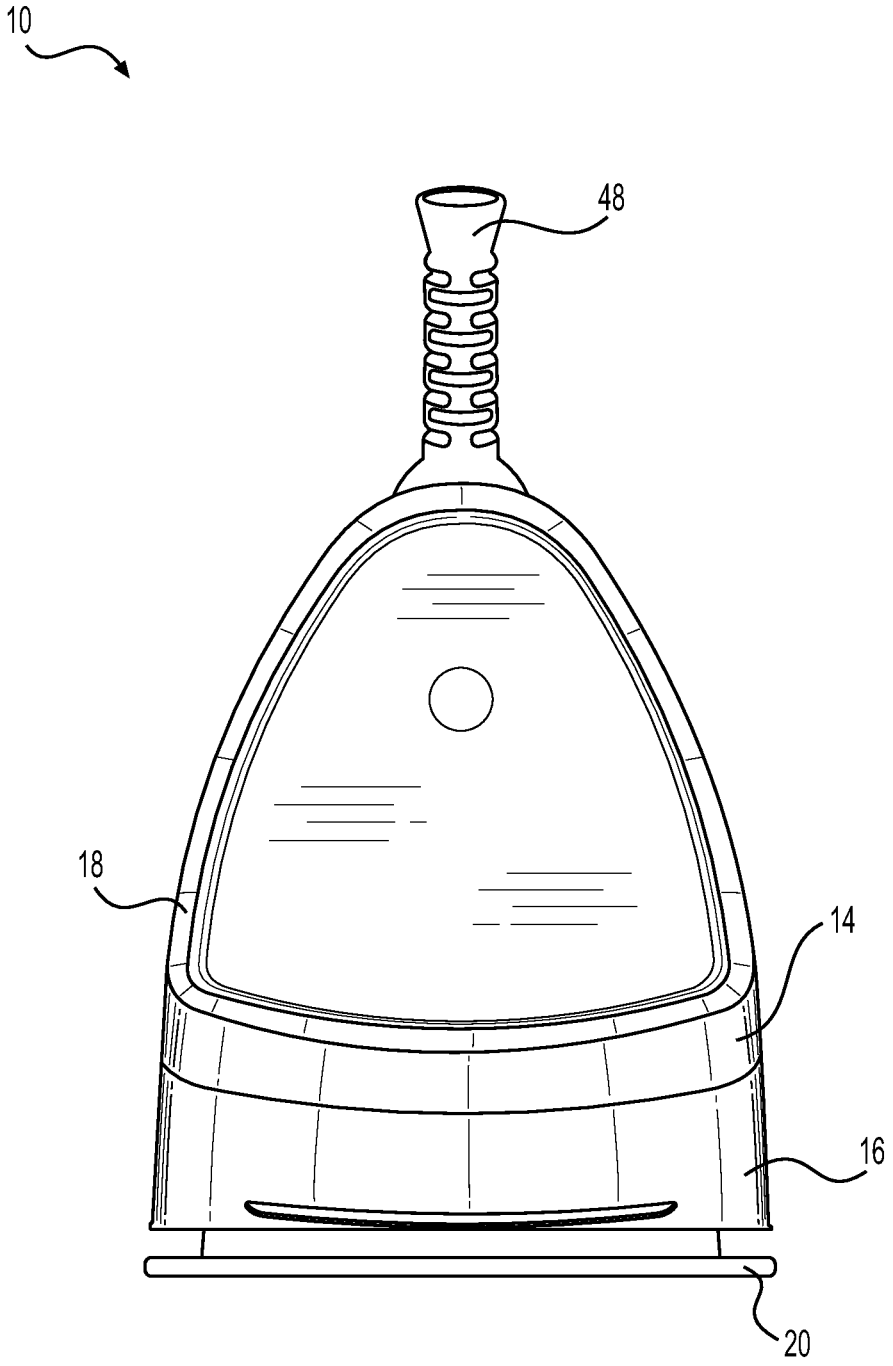
FIG. 3 is rear view of the steam iron of FIG. 1.
Figure 4:
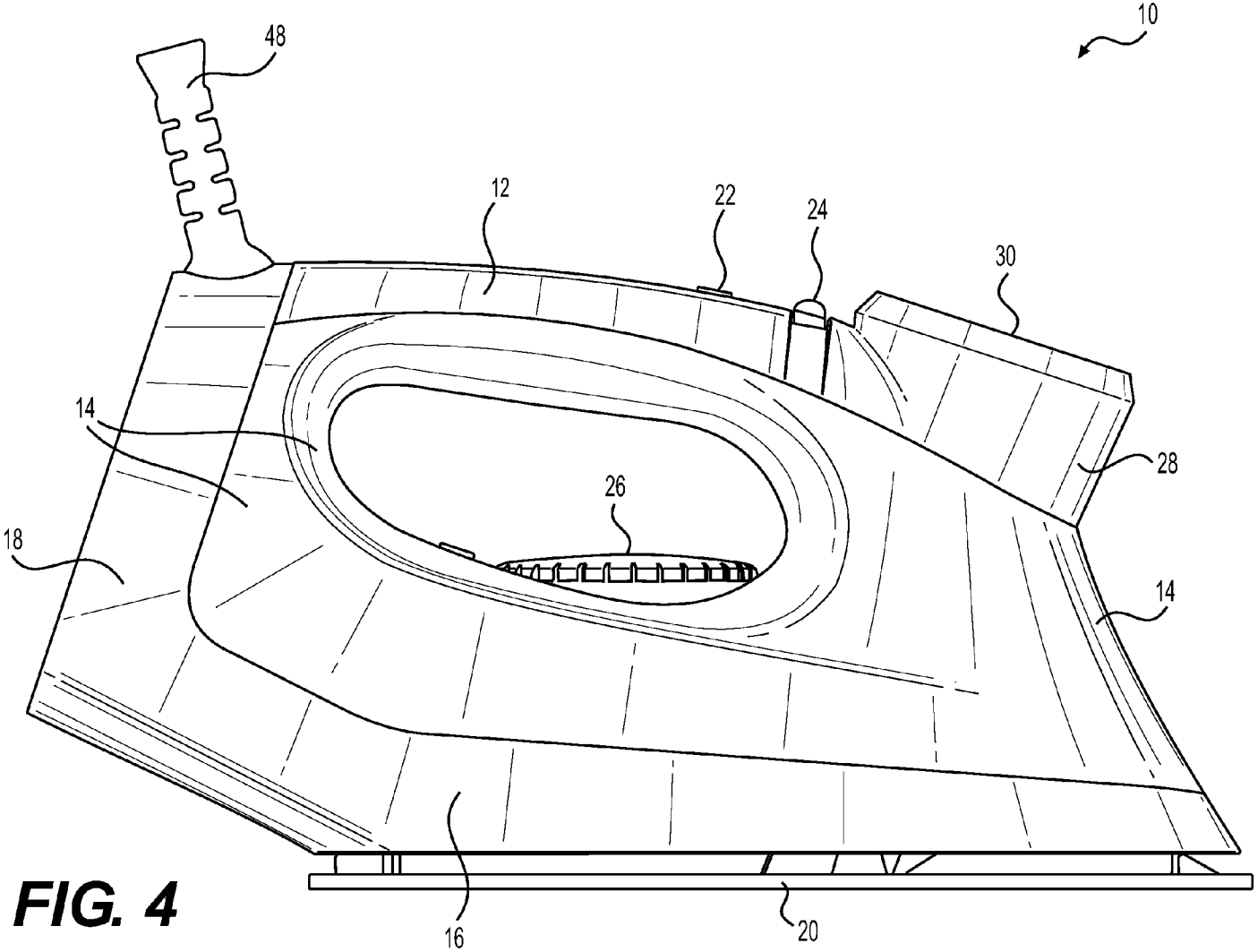
FIG. 4 is a left side view of the steam iron of FIG. 1.
Figure 5:
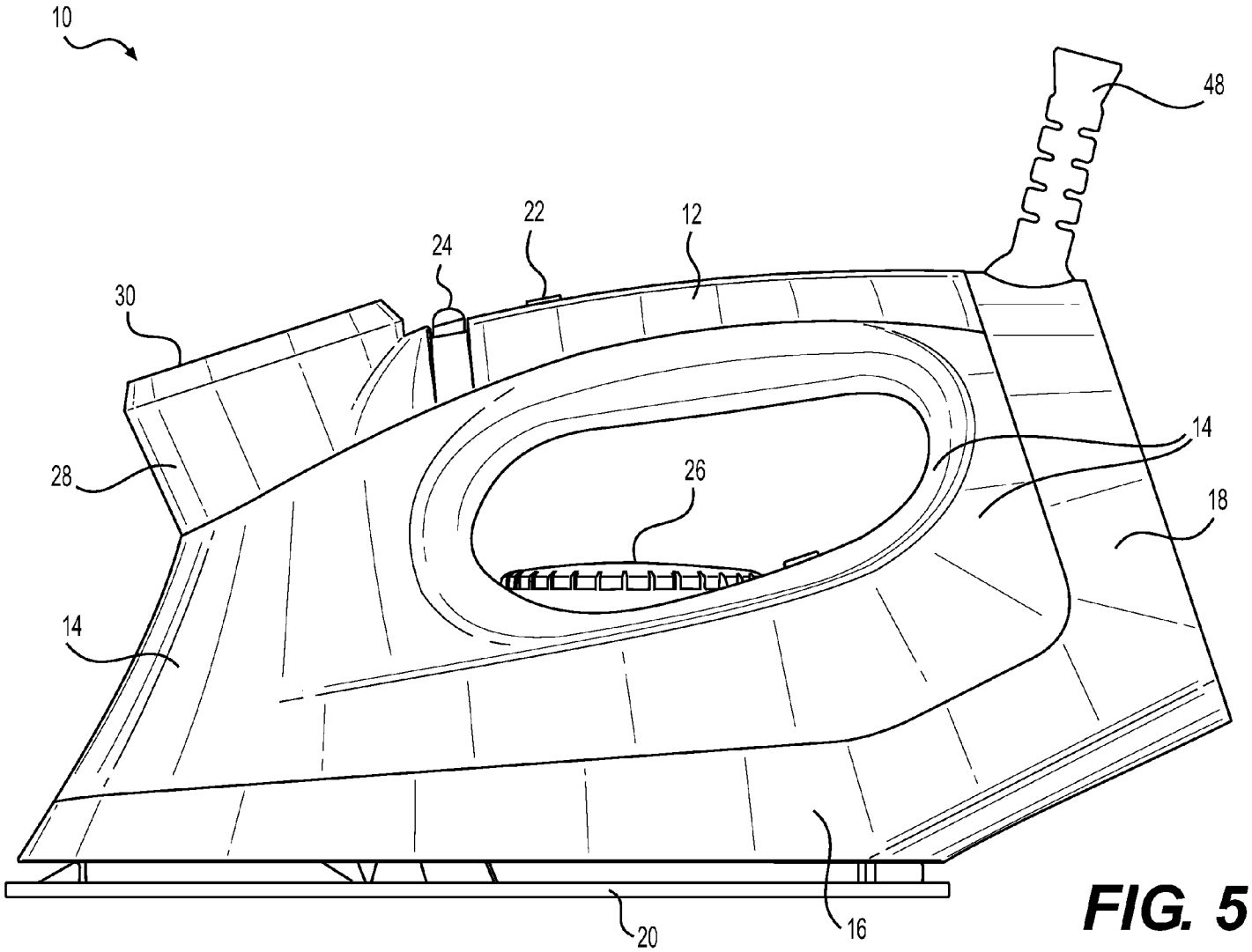
FIG. 5 is a right side view of the steam iron of FIG. 1.
Figure 6:
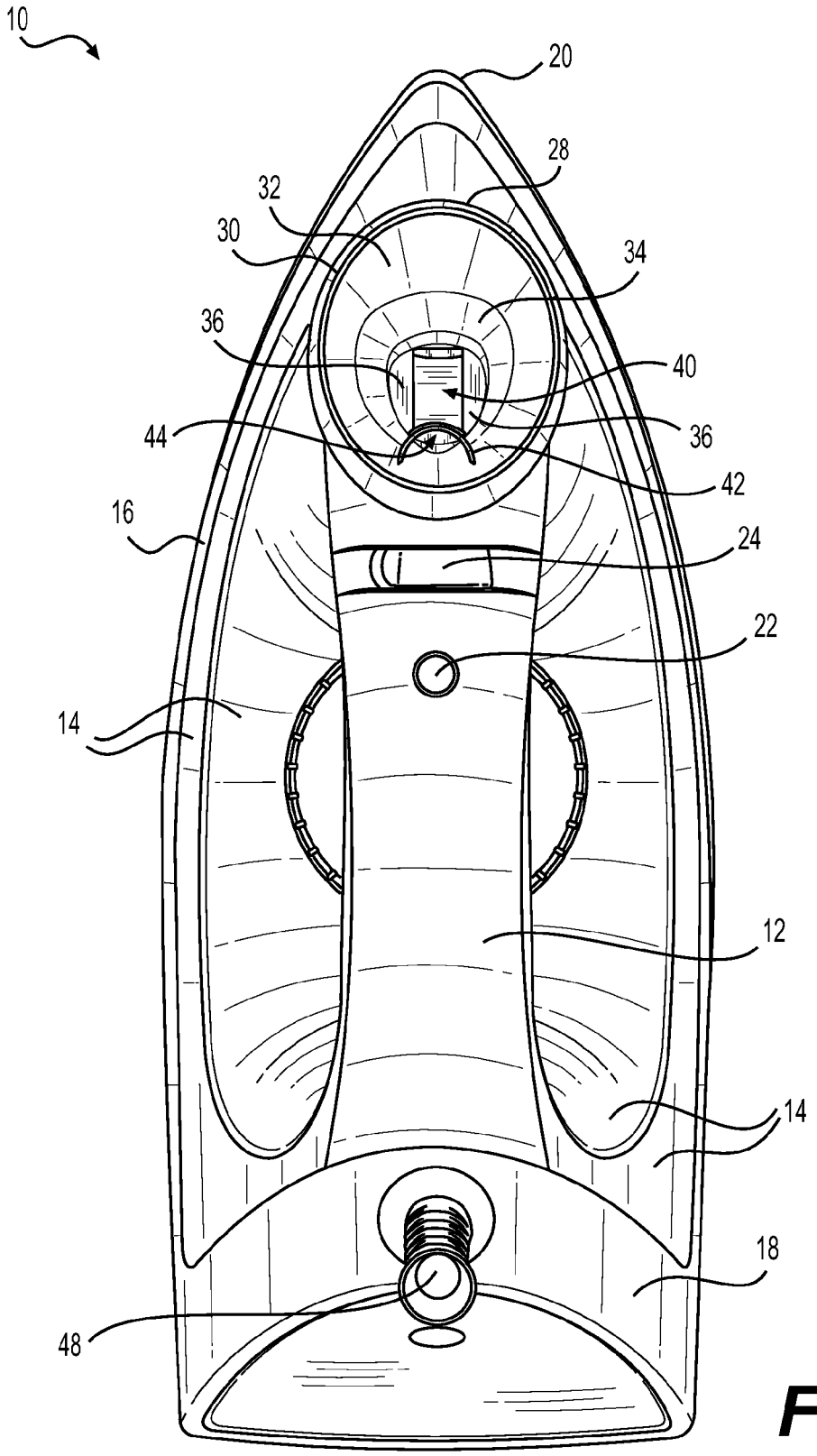
FIG. 6 is a top view of the steam iron of FIG. 1.
Figure 7:
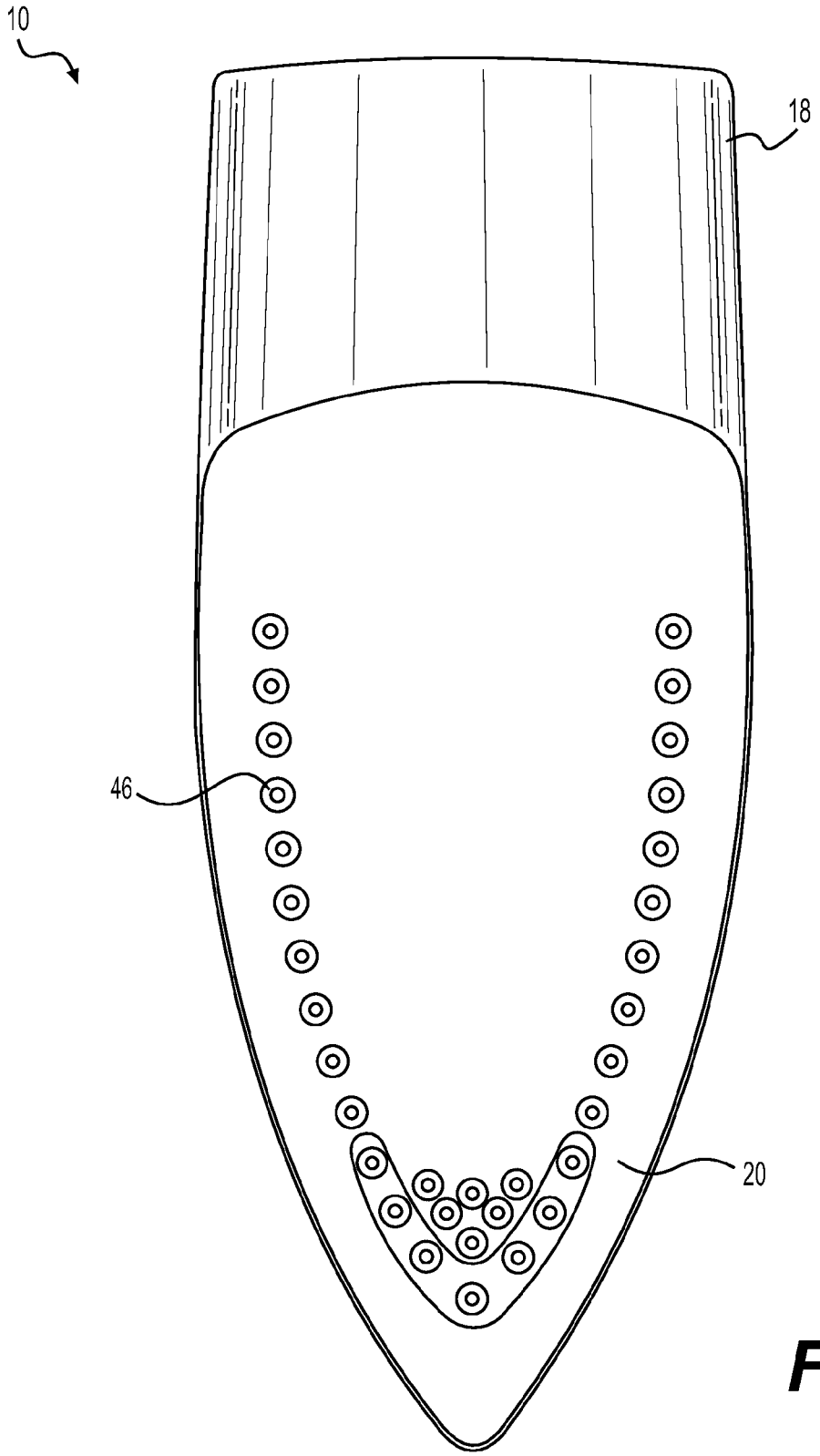
FIG. 7 is a bottom view of the steam iron of FIG. 1.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout, FIGS. 1-9 illustrate a steam iron 10 in accordance with a preferred embodiment of the present disclosure. Steam iron 10 includes a housing that comprises several portions. The housing of steam iron 10 comprises a main outer housing 14, a handle 12 joined to the main outer housing 14 to enable a user to grasp and hold steam iron 10, an insulating shell 16 that houses or is affixed to the components that heat up during operation of steam iron 10, and a housing heel 18 upon which steam iron 10 may be stood up vertically. The internal components housed within the housing are described below. Steam iron 10 further comprises a soleplate 20 affixed to the bottom of the housing. As described above, a heating element (not illustrated) located within the housing heats up soleplate 20 such that the hot soleplate may be pressed against fabric. For application of steam, water is selectively released from a water tank (described further below) onto the interior surface of the hot soleplate 20 which then vaporizes the water and the resulting steam is released through holes 46 (seen in FIG. 7) in the soleplate.

Electric power is supplied to the internal components, such as the heating element, via a power cord (not illustrated) that passes through the housing via cord bushing 48. Cord bushing 48 provides a secure, flexible connection for the power cord and provides strain relief that helps prevent damage to the power cord and helps prevent the power cord from inadvertently being pulled out of steam iron 10.

Steam iron 10 will typically comprise a plurality of user-selectable controls, such as on/off button 22 (which may include an indicator light), steam control switch 24 which controls the release of water from the water tank onto the hot soleplate, and control dial 26 which controls the temperature of soleplate 20 during operation. The number and type of user-selectable controls may vary from what is illustrated in FIGS. 1-9.

Figure 8:
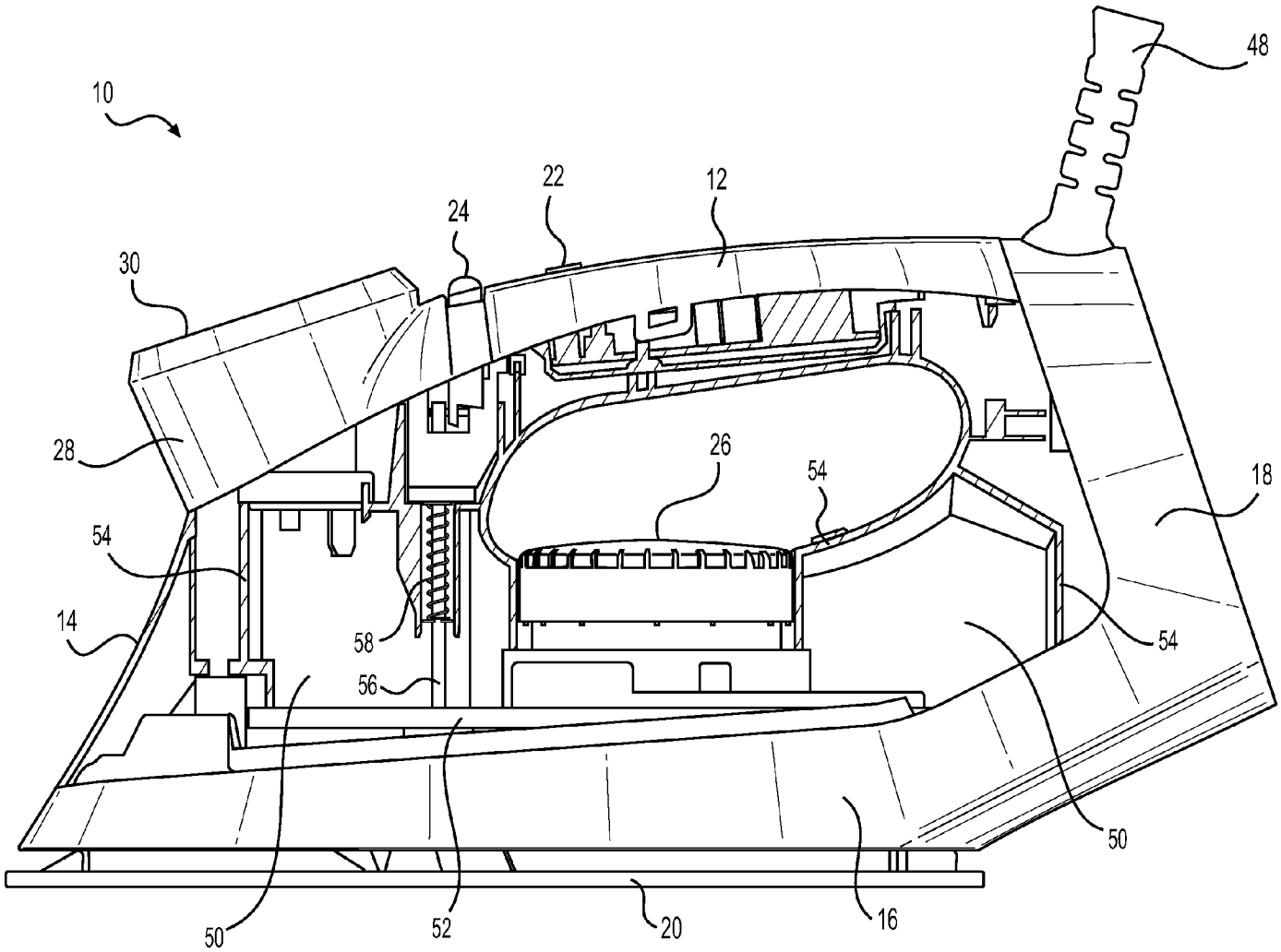
FIG. 8 is a right side view of the steam iron of FIG. 1 with a portion of the outer housing removed.
Figure 9:
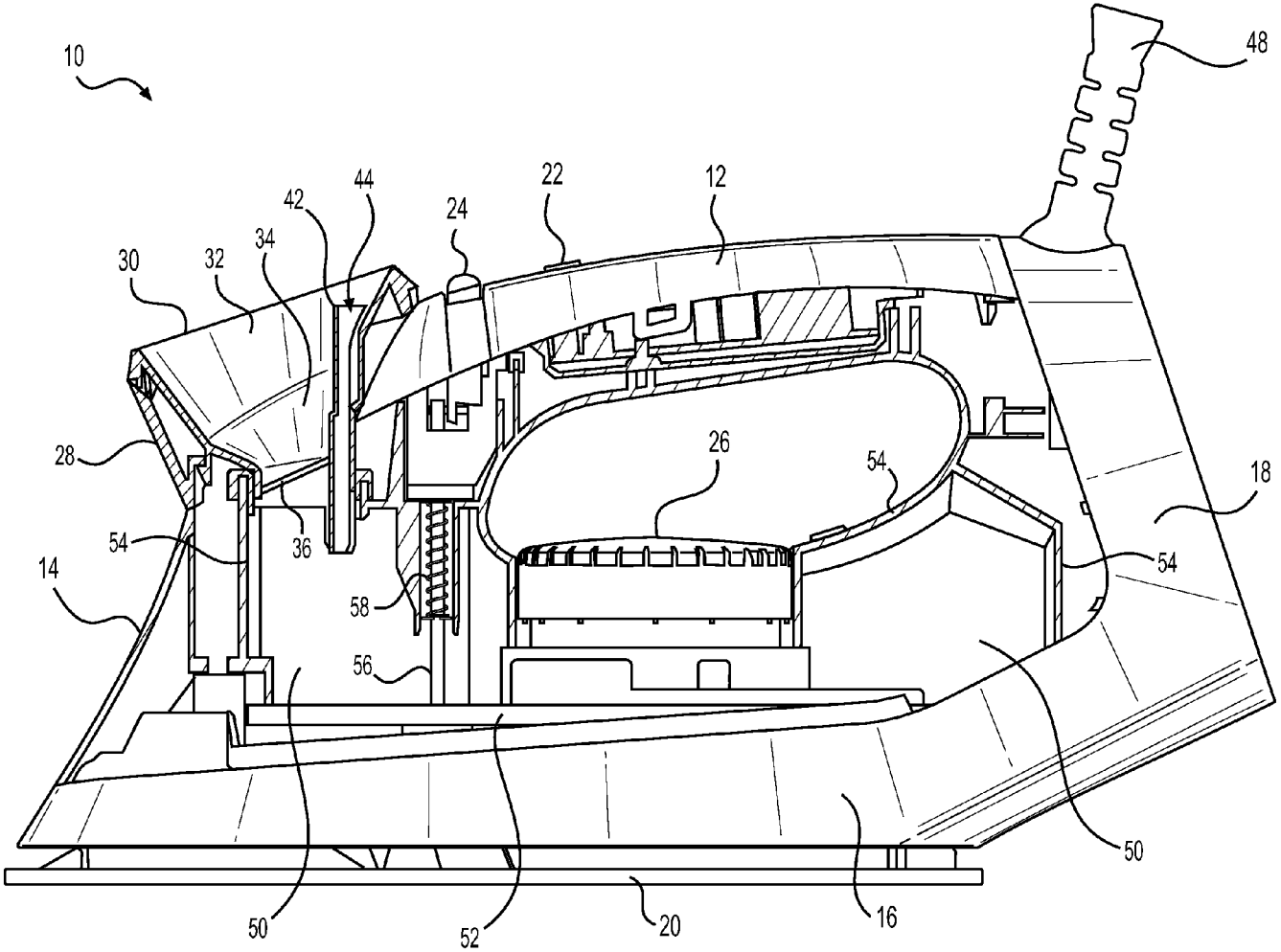
FIG. 9 is a right side view of the steam iron of FIG. 1 with a portion of the outer housing removed and with the tank fill opening cross-sectioned.

Reference is now made to FIGS. 8 and 9 in which internal components of steam iron 10 are illustrated. Within the housing of steam iron 10, a water tank 50 is defined by tank wall 54 and tank base 52. As described further below, water tank 50 may be filled via a water tank fill funnel 28. Water tank 50 holds water that may be selectively dropped through a hole (not illustrated) in tank base 52 onto hot soleplate 20 (which has been heated by a heating element (not illustrated) to the temperature selected by a user via control dial 26) to produce steam. A tank valve (not illustrated) occludes the hole in tank base 52 during non-steam operation of steam iron 10, and selectively does not occlude the hole in tank base 52 when it is desired to drop water from water tank 50 onto hot soleplate 20. The tank valve is affixed to tank valve activation rod 56 which is biased upward via spring 58. When in its biased upward position, tank valve activation rod 56 causes the tank valve to occlude the hole in tank base 52. When it is desired to selectively drop water from water tank 50 onto hot soleplate 20 to produce steam, steam control switch 24 causes water valve activation rod 56 to move downward, thereby causing the tank valve to not occlude the hole in tank base 52 and allowing water to exit water tank 50 and drop onto the top surface of soleplate 20.

Steam iron 10 further comprises a water tank fill funnel 28 at an upper front end of handle 12. Water tank fill funnel 28 is in fluid communication with water tank 50 such that a user may pour water into water tank fill funnel 28 which will then flow into water tank 50. Upper rim 30 of water tank fill funnel 28 has a generally oval shape that is longer than it is wide, although other shapes may be used (e.g., circular). Advantageously, the upper rim 30 of water tank fill funnel 28 defines a top opening that is significantly larger (whether comparing the total area of the opening, the width, and/or the length) than such openings of conventional steam irons. Additionally, the depth of water tank fill funnel 28 (as measured from upper rim 30 to lower opening 40 (seen in FIG. 6)) is significantly larger than that of conventional steam irons. As such, the volume (and therefore the water holding capacity) of water tank fill funnel 28 is significantly larger than that of conventional steam irons, such that steam iron 10 has a reduced likelihood of water backing up and overflowing the tank fill opening when the water tank is being filled.

As seen in the figures, at least a portion of the water fill funnel 28 is external to the housing. An upper portion of the water fill funnel 28 extends outward and generally upward from the housing and the handle. This advantageously presents the funnel to the user as an easy fill basin. By contrast, conventional wisdom is that the fill port is recessed in the body of an iron. A user must move the appliance into a stream of water until it is centered over the port or hope that they have properly aligned the appliance before turning on a water source. Funnel 28 reduces spills and the inconvenience of the conventional iron while permitting rapid filling, among other advantages.

One way of expressing the significantly larger size of water tank fill funnel 28 is as a percentage of corresponding measurements of steam iron 10. The width of the upper opening of water tank fill funnel 28 may be at least about 35% of the total width of steam iron 10, the length of the upper opening of water tank fill funnel 28 may be at least about 15% of the total length of steam iron 10, and the depth of water tank fill funnel 28 may be at least about 20% of the total height of steam iron 10. In the illustrated embodiment of the disclosure, the width of the upper opening of water tank fill funnel 28 is about 40% of the total width of steam iron 10, the length of the upper opening of water tank fill funnel 28 is about 20% of the total length of steam iron 10, and the depth of water tank fill funnel 28 is about 25% of the total height of steam iron 10.

As seen in FIG. 9, the interior structure of water tank fill funnel 28 is generally funnel-shaped. The water fill funnel 28 comprises an outer wall (also labeled as 28) and an inner wall 32, 34. The inner wall slopes inward more than the outer wall, as seen in FIG. 9, which defines a cavity between the inner and outer walls of the water fill funnel (again, as seen in FIG. 9). In the illustrated embodiment of the disclosure, the interior wall of water tank fill funnel 28 has two main wall portions each having a different slope. Upper interior wall portion 32 has a relatively steep slope and lower interior wall portion 34 has relatively shallow slope, as seen in FIG. 9. Water that is placed in water tank fill funnel 28 via the top opening defined by upper rim 30 flows out of water tank fill funnel 28 and into water tank 50 via lower opening 40. Lower opening 40 of water tank fill funnel 28 is flanked by two sloped, planar restrictions 36 which narrow lower opening 40 to help prevent water in water tank 50 from coming back out of water tank 50 through lower opening 40 when, e.g., steam iron 10 is moved.

Vent tube 44 defined by vent tube wall 42 extends substantially vertically along the back wall of water tank fill funnel 28 from just below upper rim 30 through lower opening 40 and into water tank 50. Vent tube 44 enables displaced air to exit water tank 50 as water tank 50 is filled with water without having the displaced air bubble up through the water, thereby reducing the likelihood of water spilling down the sides of steam iron 10.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

That which is claimed:

1. A steam iron comprising:
- a housing;
- a handle supported by or integral with the housing;
- a soleplate having a plurality of steam vents defined therein;
- a water reservoir supported by the housing for holding water to be converted to steam; and
- a water fill funnel supported by the handle for adding water to the reservoir, the water fill funnel having an upper portion including a top rim defining a top opening, the upper portion extending outward from the handle, the water fill funnel further comprising an outer wall that extends outward from the handle, the water fill funnel defining a bottom opening that is in fluid connection with the water reservoir, at least a portion of the water fill funnel being external to the housing.

2. The steam iron of claim 1, wherein the water fill funnel comprises an inner wall and the inner wall has at least two different slopes.

3. The steam iron of claim 2, wherein the at least two different slopes comprise an upper slope and a lower slope, and wherein the upper slope is steeper than the lower slope.

4. The steam iron of claim 1, wherein the water fill funnel further comprises opposing planar restrictions flanking the bottom opening of the water fill funnel.

5. The steam iron of claim 1, further comprising:
- a vent tube having an upper end that is above the bottom opening of the water fill funnel and a lower end that is below the bottom opening of the water fill funnel.

6. The steam iron of claim 1, wherein a width of the top opening of the water fill funnel is about 40% of a total width of the steam iron.

7. The steam iron of claim 1, wherein a length of the top opening of the water fill funnel is about 20% of a total length of the steam iron.

8. The steam iron of claim 1, wherein a depth of the water fill funnel is about 25% of a total height of the steam iron.

9. A steam iron comprising:
- a housing;
- a handle supported by or integral with the housing;
- a soleplate having a plurality of steam vents defined therein;
- a water reservoir supported by the housing for holding water to be converted to steam;
- a water fill funnel supported by the housing and/or the handle for adding water to the reservoir, the water fill funnel having a top rim defining a top opening, the water fill funnel defining a bottom opening that is in fluid connection with the water reservoir; and
- a vent tube having an upper end that is above the bottom opening of the water fill funnel and a lower end that is below the bottom opening of the water fill funnel.

10. The steam iron of claim 9, wherein the water fill funnel has an inner wall and the inner wall has at least two different slopes.

11. The steam iron of claim 10, wherein the at least two different slopes comprise an upper slope and a lower slope, and wherein the upper slope is steeper than the lower slope.

12. The steam iron of claim 9, wherein the water fill funnel further comprises opposing planar restrictions flanking the bottom opening of the water fill funnel.

13. The steam iron of claim 9, wherein the water fill funnel further comprises an upper portion that includes the top rim and which projects outward from the housing and/or the handle.

14. The steam iron of claim 9, wherein a width of the top opening of the water fill funnel is about 40% of a total width of the steam iron.

15. The steam iron of claim 9, wherein a length of the top opening of the water fill funnel is about 20% of a total length of the steam iron.

16. The steam iron of claim 9, wherein a depth of the water fill funnel is about 25% of a total height of the steam iron.

17. The steam iron of claim 9, wherein at least a portion of the water fill funnel is external to the housing.

18. The steam iron of claim 9, wherein the water fill funnel comprises an upper portion which includes the top rim and which extends outward from the housing and/or the handle.

19. The steam iron of claim 9, wherein the water fill funnel comprises an outer wall which extends outward from the housing and/or the handle.

* * * * *